US005557867A

United States Patent [19]

Sugawara

[11] Patent Number: 5,557,867

[45] Date of Patent: Sep. 24, 1996

[54] VARIABLE-DISPLAY DEVICE FOR AMUSEMENT

[75] Inventor: Shigeru Sugawara, Tokyo, Japan

[73] Assignee: Tenyo Co., Ltd., Tokyo, Japan

[21] Appl. No.: 420,731

[22] Filed: Apr. 11, 1995

[30] Foreign Application Priority Data

Apr. 14, 1994 [JP] Japan ..... 6-076012

[51] Int. Cl.[6] ..... G09F 11/02

[52] U.S. Cl. ..... 40/493; 40/430; 446/244

[58] Field of Search ..... 40/493, 506, 430, 40/324, 334, 486; 434/404, 426, 427, 429; 446/219, 243, 244, 408; 472/63, 72

[56] References Cited

U.S. PATENT DOCUMENTS

| | | | |
|---|---|---|---|
| 2,264,194 | 11/1941 | Wuestman | 40/334 |
| 3,621,603 | 11/1971 | De Gelder | 446/243 |
| 4,330,954 | 5/1982 | Lonsmin | 40/661 X |
| 4,381,615 | 5/1983 | Lonsmin | 40/334 |
| 5,275,277 | 1/1994 | Gallegos | 40/324 X |

*Primary Examiner*—Joanne Silbermann
*Attorney, Agent, or Firm*—Sixbey, Friedman, Leedom & Ferguson, P.C.; Gerald J. Ferguson, Jr.

[57] ABSTRACT

A variable-display device comprises an outer hollow cylinder made of a transparent material, an inner hollow cylinder disposed inside and substantially coaxially with the outer cylinder, the inner cylinder having a passage formed therein in a direction substantially parallel to the axis thereof and communicating to outside from the inside of the inner cylinder, an opaque sheet-like member made of a soft material, disposed as curled and having one end thereof located inside the inner cylinder and the other end located outside the passage formed in the inner cylinder, and an operating member fixed to the sheet-like member and disposed rotatably in relation to the outer cylinder. The outer cylinder carries a first display such as a picture, characters, figure or other pattern, and the inner cylinder carries a second display different from the first one.

When the operating member is rotated in a direction or in an opposite direction to the direction, the sheet member is moved along the outer surface of said inner cylinder through said passage to sequentially conceal said second display or reveal it through said first display. As the operating member is rotated, the display such as a picture, characters, figure or other pattern is varied gradually, which will add to the amusement.

9 Claims, 6 Drawing Sheets

VARIABLE-DISPLAY DEVICE FOR AMUSEMENT

The present invention relates to a variable-display device having a structure in which a display such as a picture, characters, figure or other pattern carried thereon can be varied by a simple operation thereof.

SUMMARY OF THE PRESENT INVENTION

The present invention has an object to provide a variable-display device having a structure in which a display such as a picture, characters, figure or other pattern carried thereon can be varied by a simple operation thereof, which will provide for a fun to see.

The variable-display device according to the present invention comprises an outer hollow cylinder made of a transparent material, carrying a first display such as a picture, characters, figure or other pattern, and an inner hollow cylinder carrying a second display different from the first one and disposed inside and substantially coaxially with the outer cylinder, the inner cylinder having a passage formed therein in a direction substantially parallel to the axis thereof and communicating to outside from the inside of the inner cylinder. Further, a shading sheet-like member made of a soft opaque material is disposed as cuffed and having one end thereof located inside the inner cylinder and the other end located outside the passage formed in the inner cylinder. The shading sheet member thus cuffed is so connected to an operating member disposed rotatably and substantially coaxially with the outer cylinder as to rotate along with the operating member which is rotated by hand.

When the operating member is rotated in a direction in relation to the outer cylinder, the shading sheet member is moved in a clearance between the outer surface of the inner cylinder and the inner surface of the outer cylinder. Thus, the shading sheet member will sequentially hide the display on the inner cylinder. On the contrary, when the operating member is rotated reversely, the shading sheet member is moved along with the operating member, so that the display on the inner cylinder will sequentially appear again.

The outer and inner cylinders of the variable-display device according to the present invention may be made each of a flexible sheet-like member, and may be placed in a cylindrical casing and held in the general shape of a cylinder in the casing.

Also, the casing may be shaped for use as a savings box, small-articles box, lipstick tube or the like.

In order that the invention may be clearly understood and readily carried into effect, the same will now be described with reference to the accompanying drawings in which:

DETAILED DESCRIPTION OF THE PREFERRED EMBODIMENTS

Figure 1:
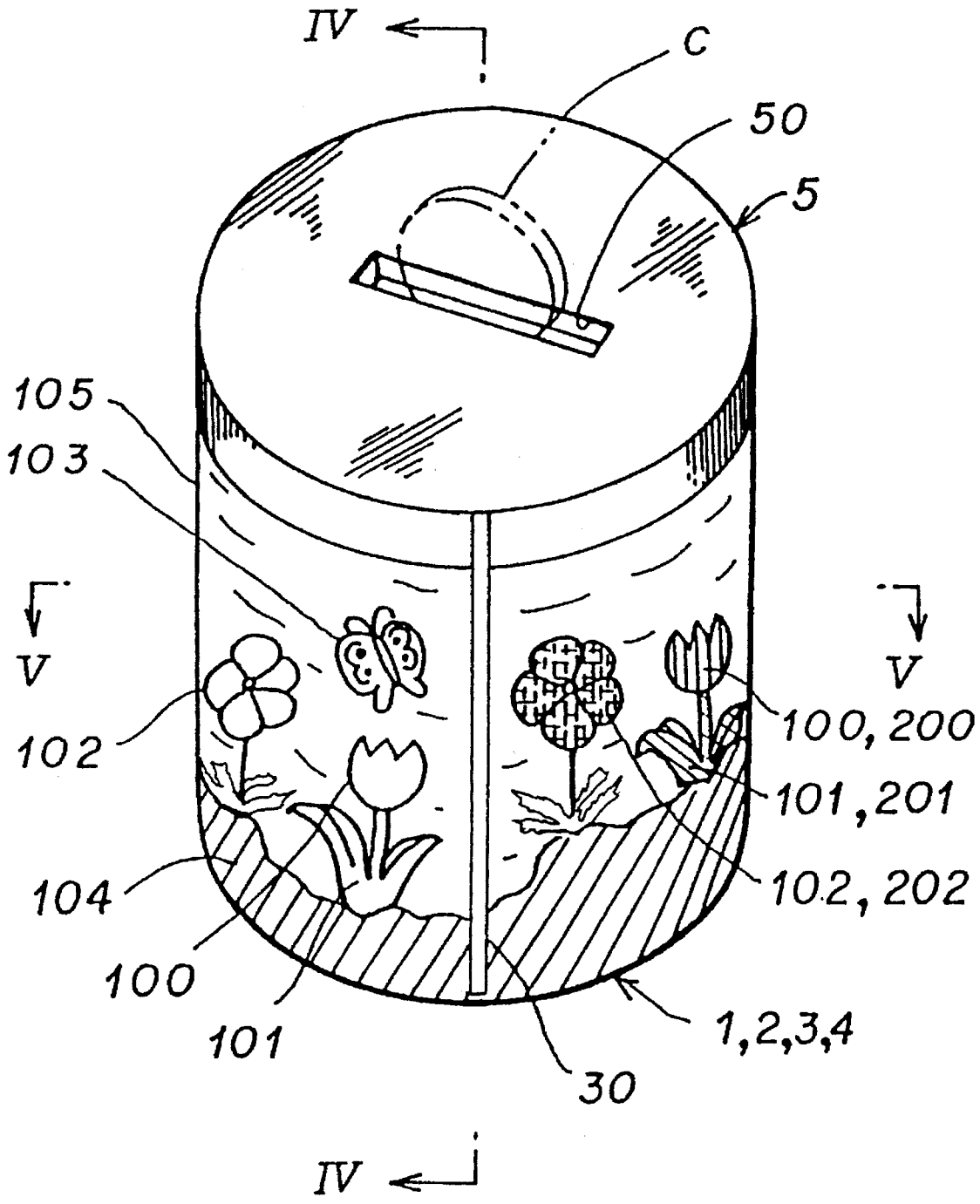
FIG. 1 is a perspective view of an embodiment of the variable-display device according to the present invention.
Figure 2:
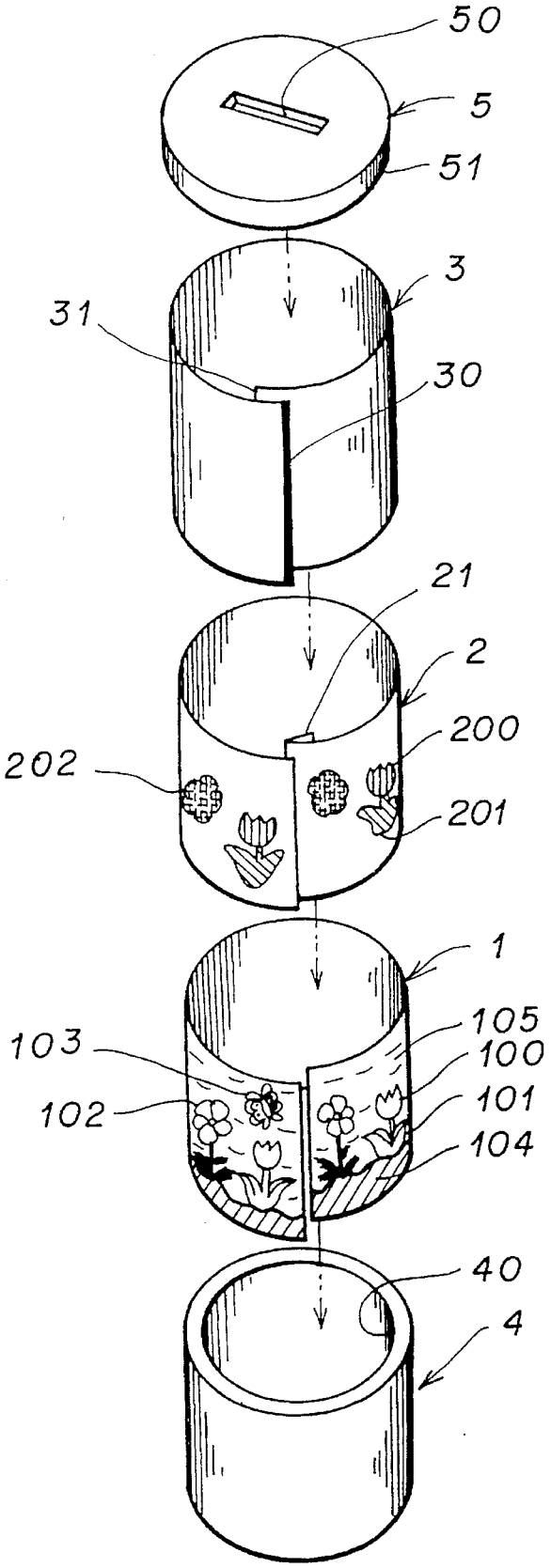
FIG. 2 is an exploded perspective view of the essential structure of the variable-display device in FIG. 1.

The accompanying drawings show three of the preferred embodiments of the variable-display device according to the present invention.

FIGS. 1 to 6 show together the first embodiment of the variable-display device according to the present invention, which is intended for use in a savings box.

In FIGURES, the savings box is generically indicated with a reference numeral 6. The savings box 6 has a structure consisting of a cylindrical body 4 open at the top thereof as indicated with a reference numeral 40, and a cylindrical lid 5 open at the bottom thereof as indicated with a reference numeral 51. The savings box 6 receives and holds therein an outer sheet 1, inner sheet 2 and shading sheet 3, all as curled, as will be further described later.

The savings box body 4 and lid 5 are made of a transparent or semitransparent material, for example, a transparent or semitransparent synthetic resin. The lid 5 has formed in the top thereof a slot 50 for reception of a coin into the box 6. The lid 5 is fitted to the body 4 with the end face of the opening 51 put in contact with the end face of the opening 40 of the body 4 in such a manner that the lid 5 is rotatable in relation to the body 4.

Figure 3:
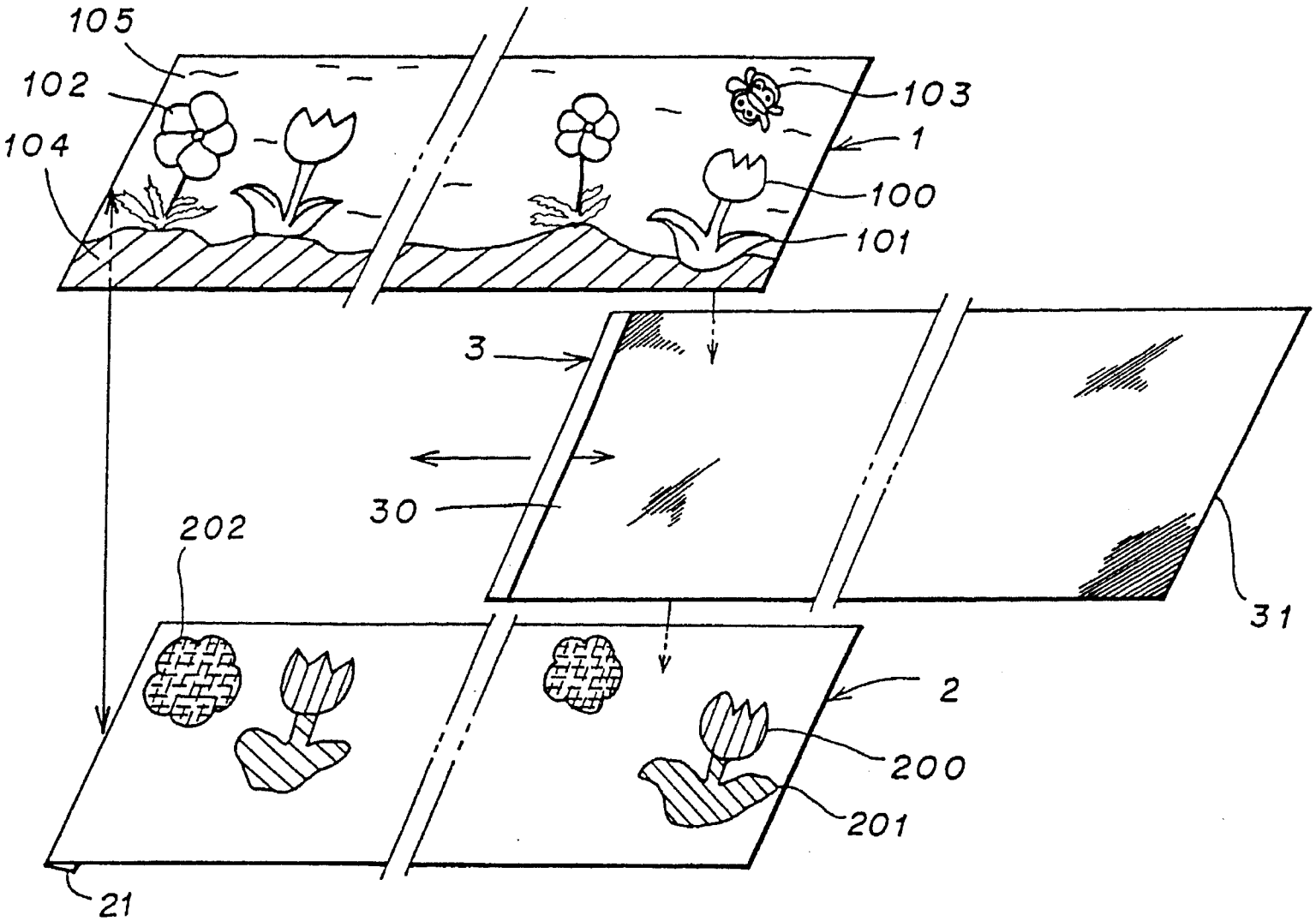
FIG. 3 is an exploded perspective view of the outer sheet, inner sheet and shading sheet.

The outer or first sheet 1 as the outer cylinder is received and held in a cylindrical shape inside the savings box body 4. The outer sheet 1 is made of a transparent or semitransparent material, for example, a soft synthetic resin sheet, has a rectangular shape and carries thereon a first display such as a picture, characters, figure or other pattern as shown in FIG. 3. In this nonlimitative first embodiment, the first display contains, for example, flowers 100 and leaves and stems 101 of tulips, flowers 100 and leaves and stems of pansies, a butterfly 103, ground 104 and sky 105. In the display, the flowers 100, leaves and stems 101 of the tulips and the pansy flowers 102 are void (non- or light-colored) while the other are appropriately colored.

When received as curled like a cylinder in the body 4, the outer sheet 1 is held in the cylindrical shape on the inner wall of the savings box body 4 owing to its own resilience. It should be noted that the outer sheet 1 may be fixed to the body 4 with an adhesive or the like.

There is disposed the inner or second sheet 2 as the inner cylinder inside the outer sheet 1. As shown in FIG. 3, the inner sheet 2 is made of a synthetic resin sheet and has a rectangular shape longer than the outer sheet 1. The inner sheet 2 carries on the surface thereof (outer surface in case the sheet 2 is made of an opaque material, or outer or inner surface or both in case the sheet 2 is made of a transparent or semitransparent material) a second display such as a picture, characters, figure or other pattern. The second display contains, for example, red flowers 200 and green leaves and stems 201 of tulips, and yellow pansy flowers 202, positioned correspondingly to the tulip flowers 100, leaves and stems 101 and pansy flowers 102, respectively, in the first display.

The inner sheet 2 is disposed as curled like a cylinder inside the outer sheet 1. It is fixed at the first end thereof (the right end thereof as in FIG. 3) to the first end (right end as in FIG. 3) of the outer sheet 1. Thus, the inner sheet 2 is held in the cylindrical shape along with the outer sheet 1 inside the savings box body 4 owing to its own resilience. It should be noted that the outer surface of the outer sheet 1 may be connected to the inner surface of the inner sheet 2 with an adhesive tape (not shown). Otherwise, the inner surface of the outer sheet 1 may be connected to the outer surface of the inner sheet 2 with an adhesive (not shown). Also, however, the outer and inner sheets 1 and 2 may be otherwise connected to each other.

The first end of the inner sheet 2 is fixed to the outer sheet 1, but the second end (left end in FIG. 3) thereof is free and resiliently forced to the inner surface of the outer sheet 1. More particularly, the first and second ends of the inner sheet 2 are separate from each other and thus define between them a clearance or passage 20 generally parallel to the axis of the savings box body 4.

The shading sheet 3 is so disposed inside the curled inner sheet 2 as to be movable in between the outer and inner sheets 1 and 2 through the passage 20. The shading sheet 3 is made of an opaque material, for example, a soft sheet such as a synthetic resin or paper, and has a rectangular shape of which the long and short sides are a little larger than those of the outer and inner sheets 1 and 2, respectively.

Figure 4:
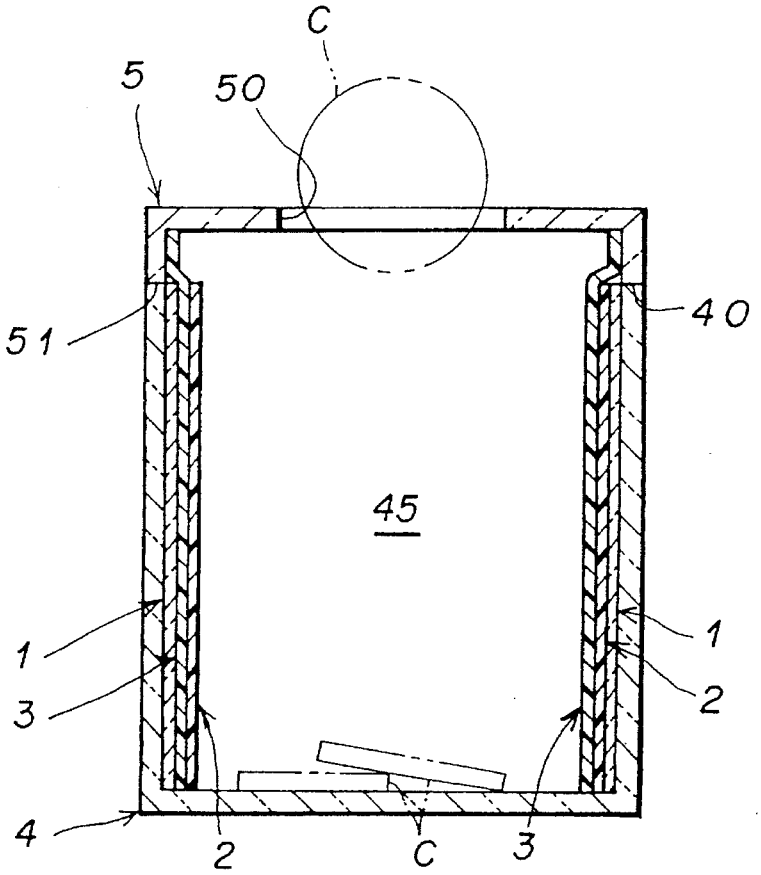
FIG. 4 is a sectional view taken along the line IV—IV in FIG. 1.
Figure 5:
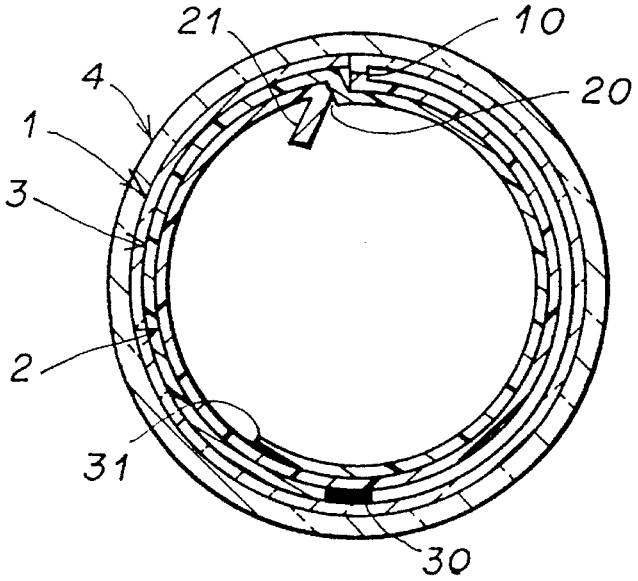
FIG. 5 is a sectional view taken along the line V—V in FIG. 1.
Figure 6A:
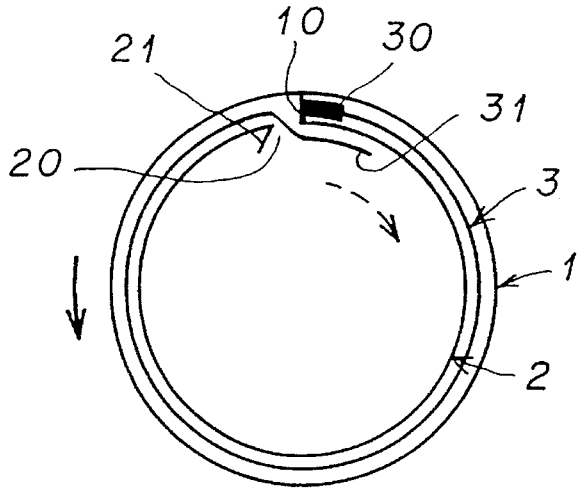
FIGS. 6(A), 6(B) and 6(C) show together how a display such as a picture, characters, figure or other pattern is changed due to a rotation of the shading sheet in relation to the outer and inner sheets.
Figure 6B:
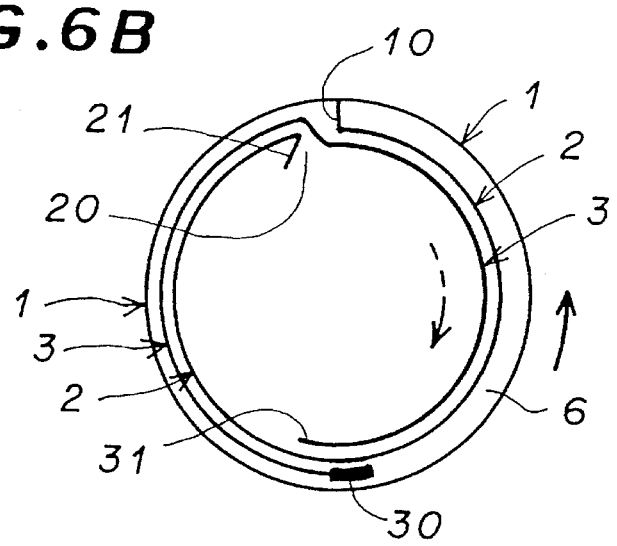

As shown in FIGS. 5 and 6, one end of the shading sheet 3 is disposed inside the inner sheet 2 while the other end is passed through the passage 20 and disposed as curled outside the inner sheet 2. Thus, the shading sheet 3 is received in the cylindrical shape together with the outer and inner sheets 1 and 2 in the savings box body 4. As shown in FIG. 4, the upper edge of the shading sheet 3 projects above the upper edge of the outer and inner sheets 1 and 2, and the projecting upper edge portion is received and resiliently held inside the savings box lid 5. The shading sheet 3 should preferably be fixed to the inner wall of the savings box lid 5 with an adhesive or the like. Thus, the shading sheet 3 is disposed rotatably in relation to the outer and inner sheets 1 and 2.

Further, the shading sheet 3 has provided at the end thereof located outside the inner sheet 2, that is, at the left end (first end) in FIG. 3, an opaque line 30 colored (in black or any other color, for example).

As shown in FIGS. 5 and 6, there is provided a first stopper 10. The first stopper 10 is formed from the connection between the first ends, fixed to each other, of the outer and inner sheets 1 and 2, respectively and serves to limit the shading sheet 2 from being excessively moved outwardly of the inner sheet 2 (in the direction of solid-line arrow in FIG. 6). There is also provided a second stopper 21 formed by folding the second end portion (left end in FIG. 3) of the inner sheet 2 inwardly into a V-shape. This second stopper 21 serves to limit the shading sheet 3 from being excessively moved inwardly of the inner sheet 2 (in the direction of broken-line arrow in FIG. 3).

The variable-display device according to this embodiment is constructed as having been explained in the foregoing. How to use the device and how it works will be described herebelow:

As shown in FIG. 6(A), when the shading sheet 3 extends generally all way from the passage 20 to the first stopper 10 in between the outer and inner sheets 1 and 2 and the colored opaque line 30 on the shading sheet 3 abuts the first stopper 10, the shading sheet 3 conceals the inner sheet 2 from external viewing. So, there appear on the savings box body 4 the tulip flowers 100, tulip leaves and stems 101, pansy flowers 102, pansy leaves and stems, butterfly 103, ground 104 and sky 105. From this position, the savings box body 4 to which the outer and inner sheets 1 and 2 are secured is rotated in the direction of solid-line arrow (counterclockwise) or the savings box lid 5 to which the shading sheet 3 is fixed is rotated in the direction of broken-line arrow (clockwise). Namely, both the savings box body 4 and lid 5 are rotated in opposite directions, or either of them is rotated while the other is kept stationary. In any case, the savings box body 4 and lid 5 are rotated in relation to each other.

Then, the shading sheet 3 extending between the outer and inner sheets 1 and 2 is moved inside the inner sheet 2 through the passage 20. Thus, the colored opaque line 30 leaves the first stopper 10 and there will arise a blank area 6 between the outer and inner sheets 1 and 2, extending from the opaque line 30 to the first stopper 10, where the shading sheet 3 does not exist. Since the shading sheet 2 concealing the inner sheet 2 from external viewing does not exists in the blank area 6, the red tulip flowers 200, green tulip leaves and stems 201, and yellow pansy flowers 202 carded on the inner sheet 2 will be visible from outside through the tulip flowers 100, tulip leaves and stems 101 and pansy flowers 102, respectively, carded on the outer sheet 1.

As the above-mentioned rotation of the savings box body 4 or lid 5 or both is further done gradually, the shading sheet 3 will gradually enter inside the inner sheet 2 from between the outer and inner sheets 1 and 2 and the blank area 6 will gradually increase, and the red tulip flowers 200, green tulip leaves and stems 201, and yellow pansy flowers 202 carded on the inner sheet 2 will gradually be visible from outside through the tulip flowers 100, tulip leaves and stems 101 and pansy flowers 102, respectively, carried on the outer sheet 1.

The above-mentioned rotation will be terminated when the second end 31 (right end in FIG. 3) of the shading sheet 3 abuts the second stopper 21 of the inner sheet 2. At this time, a larger part of the shading sheet 3 between the outer and inner sheets 1 and 2 has moved to inside the inner sheet 2 through the passage 20, and so the blank area 6 between the outer and inner sheets 1 and 2 has become larger. The red tulip flowers 200, green tulip leaves and stems 201, and yellow pansy flowers 202 carded on the inner sheet 2 will be visible from outside through the tulip flowers 100, tulip leaves and stems 101 and pansy flowers 102, respectively, carded on the outer sheet 1. Thus, the first display such as pictures and patterns on the outer sheet 1 varies in combination with the second display such as corresponding pictures and patterns on the inner sheet 2.

Figure 6C:
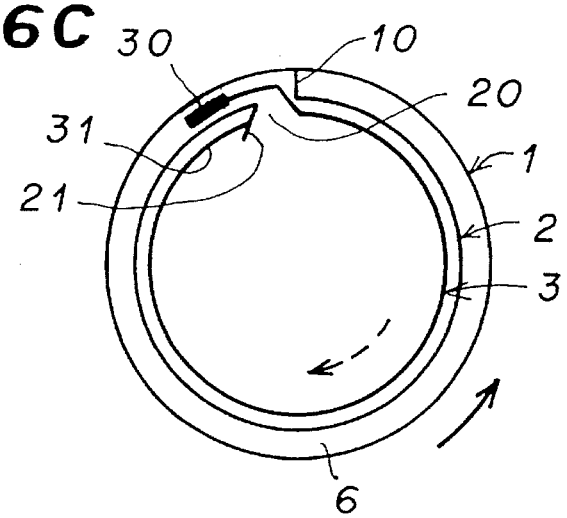

In FIG. 6(C), the second end 31 of the shading sheet 3 abuts the second stopper 21 of the inner sheet 2. The savings box body 4 to which the outer and inner sheets 1 and 2 are secured is rotated in a direction opposite to the solid-line arrow (clockwise) while the lid 5 fixed to the shading sheet 3 is rotated in a direction opposite to the broken-line arrow (counterclockwise), both from the position in FIG. 6(C).

Then, the shading sheet 3 having been inside the inner sheet 2 comes to between the outer and inner sheets 1 and 2 through the passage 20. The colored opaque line 30 on the shading sheet 3 comes near the first stopper 10 through the passage 20. At this time, the shading sheet 3 will extend between the outer and inner sheets 1 and 2 in a range from the line 30 to the passage 20. In the range where the shading sheet 3 extends, the outer surface of the inner sheet 2 is concealed by the shading sheet 3. So, the red tulip flowers 200, green tulip leaves and stems 201, and yellow pansy flowers 202 carried on the inner sheet 2 will disappear from their respective combination with the tulip flowers 100, tulip leaves and stems 101 and pansy flowers 102 on the outer sheet 1.

As the above-mentioned rotation is further done gradually, the shading sheet 3 inside the inner sheet 2 will gradually move to between the outer and inner sheets 1 and 2 and the concealing of the inner sheet 2 by the shading sheet 3 will gradually increase, and the red tulip flowers 200, green tulip leaves and stems 201, and yellow pansy flowers 202 carried on the inner sheet 2 will gradually disappear from their respective combination with the tulip flowers 100, tulip leaves and stems 101 and pansy flowers 102 on the outer sheet 1.

The above-mentioned rotation will be terminated when the colored opaque line 30 abuts the first stopper 10 as shown in FIG. 5(A). At this time, the shading sheet 3 extends between the outer and inner sheets 1 and 2 nearly over the total area from the passage 20 to the first stopper 10. So, the red tulip flowers 200, green tulip leaves and stems 201, and yellow pansy flowers 202 carried on the inner sheet 2 will disappear from their respective combination with the tulip flowers 100, tulip leaves and stems 101 and pansy flowers 102 on the outer sheet 1. Thus, the combination of the first display on the outer sheet 1 and second display on the inner sheet 2 changes to the first display on the outer sheet 1.

By rotating the savings box body 4 to which the outer and inner sheets 1 and 2 are secured, in relation to the lid 5 to which the shading sheet 3 is fixed, it is possible to add the second display on the inner sheet 2 to the first display on the outer sheet 1 to provide a composite display resulted from the addition or to conceal the second display on the inner sheet 2. Thus, the display viewable through the savings box body 4 can be varied gradually, which will provide a fun to see. In addition, this variable-display device according to the present invention is very simple in structure and easy to operate as having been described in the foregoing.

According to this embodiment, the outer, inner and shading sheets 1, 2 and 3 are enclosed in the savings box 6 having formed in the top thereof the coin slot 50 through which a coin C can be put in to the box.

In this embodiment, the stoppers 10 and 21, first and second, are provided to limit the shading sheet 3 from being excessively moved inwardly, and outwardly, of the inner sheet 2 through the passage 20. Thus, the shading sheet 3 can be prevented by such stoppers from being totally put inside the inner sheet 2 or in between the outer and inner sheets 1 and 2. The shading sheet 3 will not go limitlessly inside the inner sheet 2 or in between the outer and inner sheets 1 and 2 to impair the function of display variation.

The stoppers are provided on the outer and inner sheets 1 and 2, respectively. However, they may be provided on the savings box 6 consisting of the body 4 and lid 5. For example, a circular recess is formed in either the body 4 or lid 5 and a stopping projection is provided in the recess, while a stopping piece is provided on the other (4 or 5) to slidably fit in the recess and engage the stopping projection. Alternatively, the stoppers may be provided on both the sheets and box body. However, the stoppers are not always necessary.

In this embodiment, the display such as picture or pattern varies along the colored opaque line 30 marked on the first end of the shading sheet 3 between the outer and inner sheets 1 and 2, which will add to the amusement.

Figure 7:
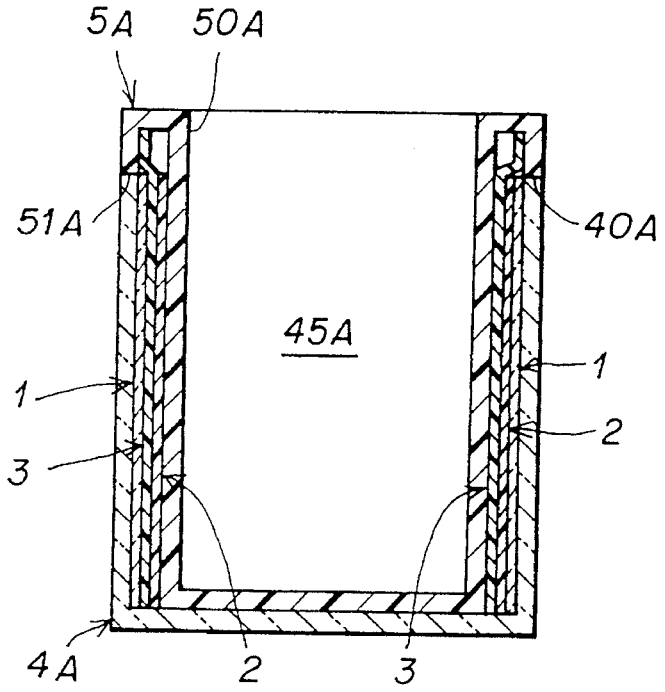
FIG. 7 is an axial sectional view of another embodiment of the variable-display device according to the present invention.

FIG. 7 is an axial sectional view of the second embodiment of the variable-display device according to the present invention, wherein like reference characters designate corresponding parts in FIGS. 1 to 6.

This second embodiment uses a small-articles box in place of the savings box 6 (consisting of the body 4 and lid 5) in the first embodiment. The box in this embodiment consists of an outer hollow cylindrical case 4A open at the top thereof (indicated at 40A), and an inner hollow cylindrical case 5A open at the top thereof (indicated at 50A) and having an extension 51A formed outwardly of the circumferential edge of the opening 50A. The inner case 5A is rotatably housed in the outer case 4A and the extension 51A of the inner case 5A is also rotatably fitted on the open end of the outer case 4A. The outer, inner and shading sheets 1, 2 and 3 are enclosed in a nearly cylindrical shape in a clearance defined between the outer and inner cases 4A and 5A. The outer and inner sheets 1 and 2 are coupled to the inner surface of the outer case 4A and the shading sheet 3 is coupled to the outer surface of the inner case 5A, in such a manner that the outer and inner sheets 1 and 2 can be rotated in relation to the shading sheet 3 in the space between the outer and inner cases 4A and 5A. An adhesive or the like may be used to secure the outer sheet 1 to the inner surface of the outer case 4A and the shading sheet 3 to the extension 51A of the inner case 5A. The small-articles box thus assembled is open at the stop thereof (50A) and a compartment space 45A. The portions of the outer and inner cases, corresponding to or facing, at least the first display on the outer sheet 1 and second display on the inner sheet 2 are made transparent.

The second embodiment described above can be used to receive small articles and provides a same amusement like the first embodiment.

Figure 8:
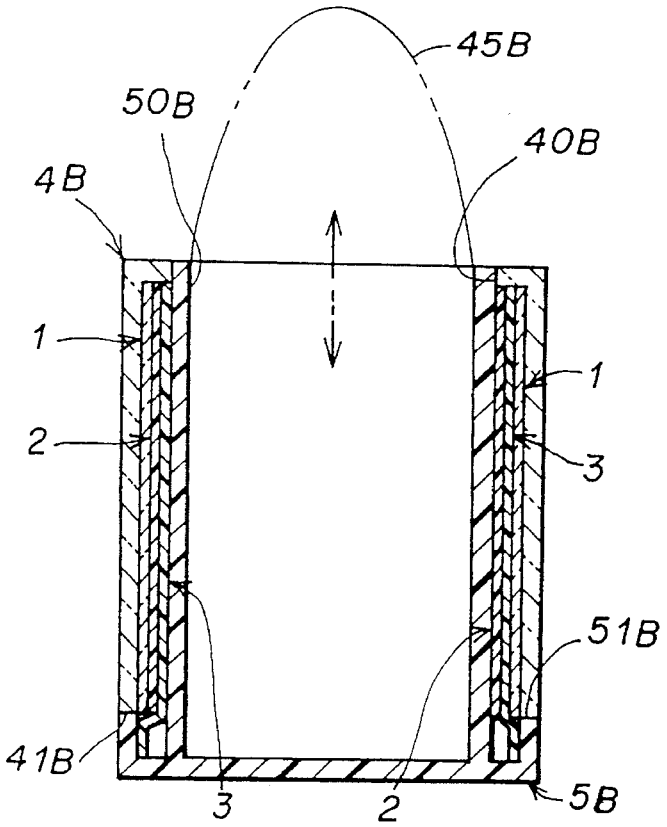
FIG. 8 is an axial sectional view of a still another embodiment of the variable-display device according to the present invention.

FIG. 8 is an axial sectional view of the third embodiment of the variable-display device according to the present invention, wherein like reference characters designate corresponding parts in FIGS. 1 to 7.

This third embodiment uses a lipstick tube consisting of an outer case 4B and inner case 5B (with a lipstick protrusion mechanism) in place of the savings box 6 (consisting of the body 4 and lid 5) in the first embodiment and a small-articles box in the second embodiment (consisting of the cases 4A and 5A). The tube in this embodiment consists of an outer hollow cylindrical case 4B open at the top thereof (indicated at 40B) and at the bottom thereof (indicated at 41B), and an inner hollow cylindrical case 5B open at the top thereof (indicated at 50B) and having an extension 51B formed from the bottom circumferential edge toward the top opening 50B. The inner case 5B is rotatably housed in the outer case 4B and the extension 51B of the inner case 5B is also rotatably fitted on the open end (41B) of the outer case 4B. A lipstick 45B is disposed in the inner case 5B in such a manner as to be forwarded and retreated by a plunger mechanism (not shown). The outer, inner and shading sheets 1, 2 and 3 are enclosed in a nearly cylindrical shape in a clearance defined between the outer and inner cases 4B and 5B. The outer and inner sheets 1 and 2 are coupled to the inner surface of the outer case 4B and the shading sheet 3 is coupled to the outer surface of the inner case 5B, in such a manner that the outer and inner sheets 1 and 2 can be rotated in relation to the shading sheet 3 in the space between the outer and inner cases 4B and 5B. An adhesive or the like (not shown) may be used to secure the outer sheet 1 to the inner surface of the outer case 4B and the shading sheet 3 to the extension 51B of the inner case 5B. The lipstick protrusion mechanism referred to in the above is a well-known one in which the lipstick 45B is protruded from inside the inner case 5B or retreated into the inner case 5B by rotating the outer and inner cases 4B and 5B in relation to each other.

The third embodiment described above can be used as a lipstick tube for the lipstick 45B and provides a same amusement like the first and second embodiments.

The casing for the variable-display device according to the present invention may be any casing or the like other than the savings box, small-article box, lipstick tube, etc.

In the variable-display device according to the present invention, the above-mentioned casing for the sheets may not always be made of any rigid material. Further, such casing is not required in case the outer and inner sheets 1 and 2 are made of any material rigid enough to support themselves.

In the aforementioned embodiments, the outer, inner and shading sheets 1, 2 and 3 are curled in a cylindrical shape approximate to the inner wall of a casing for enclosing them. However, these sheets may be curled in any other shapes like a cone, truncated cone or the like. Also, the above-mentioned casing may be made transparent at portions thereof corresponding to at least the first display on the outer sheet 1 and second display on the inner sheet 2.

Note that in the sectional views in FIGS. 4, 5, 7 and 8, the thickness of the outer, inner and shading sheets 1, 2 and 3 is shown larger than actual for the convenience of illustration and reading.

What is claimed is:

1. A variable-display device, comprising:

an outer hollow cylinder made of a transparent material, carrying a first display such as a picture, characters, figure or other pattern;

an inner hollow cylinder carrying a second display different from said first one and disposed inside and substantially coaxially with said outer cylinder, said inner cylinder having a passage formed therein in a direction substantially parallel to the axis thereof and communicating to outside from the inside thereof;

a shading sheet-like member made of a soft opaque material, disposed as curled and having one end thereof located inside said inner cylinder and the other end located outside said passage formed in said inner cylinder; and an operating member coupled to said shading sheet member and disposed rotatably in relation to said outer cylinder;

said shading sheet member being movable along the outer surface of said inner cylinder through said passage, upon rotation of said operating member in a direction or in an opposite direction, to sequentially conceal said second display or reveal it through said first display.

2. A variable-display device as set forth in claim 1, further comprising:

a first stopper to limit said shading sheet member from being excessively moved inwardly of said inner cylinder; and a second stopper to limit said shading sheet member from being excessively moved outwardly of said inner cylinder.

3. A variable-display device as set forth in claim 1, wherein said opaque sheet member has provided at the other end thereof a colored opaque line extending along said passage.

4. A variable-display device, comprising:

a cylindrical casing made of a transparent material;

a first elongated sheet-like member made of a transparent material, carrying a first display such as a picture, characters, figure or other pattern, and held as curled inside, and fixed to, said casing;

a second elongated sheet-like member, carrying a second display different from said first display, and held as curled inside, and fixed to, said first sheet member, the two opposite ends thereof being separated from each other;

a passage defined between the two opposite ends of said second sheet member;

an opaque shading sheet-like member made of a soft material, disposed as so curled as to have one end thereof located inside said second sheet member and the other end located outside said second sheet member through said passage; and an operating member disposed rotatably in relation to said casing and to which a part of said shading sheet member is coupled;

said shading sheet member being movable along the outer surface of said second sheet member through said passage, upon rotation of said operating member in a direction or in an opposite direction, to sequentially conceal said second display or reveal it through said first display.

5. A variable-display device as set forth in claim 4, wherein said casing is a savings box consisting of a hollow cylindrical body open at the top thereof and a lid having a coin slot formed therein and fitted removably and rotatably on the open end of said body, said shading sheet member being partially coupled to said lid which thus will serve as said operating member.

6. A variable-display device as set forth in claim 4, wherein said casing comprises an outer hollow cylindrical case open at the top thereof and an inner hollow cylindrical case open at the top thereof and having an extension formed outwardly of the circumferential edge of the opening, said inner case being rotatably housed in said outer case while said extension of said inner case is also rotatably fitted on the open end of said outer case;

said first, second and shading sheets being enclosed in a nearly cylindrical shape in a clearance defined between said outer and inner cases;

said first and second sheets being coupled to the inner surface of said outer case while the shading sheet 3 is coupled to the outer surface of said inner case;

the portions of said outer and inner cases, corresponding to or facing, at least said first display on said first sheet and second display on said second sheet being transparent.

7. A variable-display device as set forth in claim 4, wherein said casing is a lipstick tube consisting of an outer hollow cylindrical case open at both the top and bottom thereof and an inner hollow cylindrical case open at the top thereof and having an extension formed from the bottom circumferential edge toward the top opening;

said inner case is rotatably housed in said outer case, while said extension of said inner case is also rotatably fitted on said open end of said outer case, a lipstick being disposed in said inner case in such a manner as to be forwarded and retreated by a protrusion mechanism;

said first, second and shading sheets are enclosed in a nearly cylindrical shape in a clearance defined between said outer and inner cases;

said first and second sheets are coupled to the inner surface of said outer case while said shading sheet is coupled to the outer surface of said inner case; and wherein the portions of said outer and inner cases, corresponding to or facing, at least said first display on said first sheet and second display on said second sheet are transparent.

8. A variable-display device as set forth in claim 4, further comprising:

a first stopper to limit said shading sheet member from being excessively moved inwardly of said second sheet member through said passage; and a second stopper to limit said shading sheet member from being excessively moved outwardly of said second sheet member through said passage.

9. A variable-display device as set forth in claim 4, wherein said shading sheet member has provided at the other end thereof a colored opaque line extending along said passage.

* * * * *